US006739378B2

(12) United States Patent
Sugita et al.

(10) Patent No.: US 6,739,378 B2
(45) Date of Patent: May 25, 2004

(54) INTERNAL CHILL CASTING METHOD FOR MANUFACTURING A CAST PRODUCT CONTAINING A PIPE THEREIN

(75) Inventors: Kaoru Sugita, Tokyo (JP); Yoshihiro Tajima, Shizuoka-ken (JP); Masayuki Yasuda, Tomakomai (JP); Tetsuo Ishikawa, Tomakomai (JP); Masahide Hamada, Itami (JP); Yoshiki Matsuzaki, Itami (JP)

(73) Assignees: Nippon Light Metal Co., Ltd., Tokyo (JP); Sumitomo (SEI) Brake Systems, Inc., Mie-ken (JP)

( * ) Notice: Subject to any disclaimer, the term of this patent is extended or adjusted under 35 U.S.C. 154(b) by 0 days.

(21) Appl. No.: 09/756,825

(22) Filed: Jan. 9, 2001

(65) Prior Publication Data

US 2001/0008182 A1 Jul. 19, 2001

(30) Foreign Application Priority Data

Jan. 14, 2000 (JP) ..... 2000-005351

(51) Int. Cl.[7] ..... B22D 19/00
(52) U.S. Cl. ..... 164/112; 164/332
(58) Field of Search ..... 164/112, 332, 164/333, 334

(56) References Cited

U.S. PATENT DOCUMENTS 1,484,434 A * 2/1924 Thompson ..... 164/112
2,890,505 A * 6/1959 Brand ..... 164/112
4,066,115 A * 1/1978 Ohtani et al. ..... 164/9
4,865,112 A * 9/1989 Schwarb et al. ..... 164/34

FOREIGN PATENT DOCUMENTS

| | | | |
|---|---|---|---|
| FR | 1.243.333 | * | 12/1960 |
| JP | 40-4123854 A | * | 4/1992 |
| JP | 40-4294855 A | * | 10/1992 |
| JP | 2000254768 | | 9/2000 |

* cited by examiner

*Primary Examiner*—M. Alexandra Elve
*Assistant Examiner*—Len Tran
(74) *Attorney, Agent, or Firm*—Webb Ziesenheim Logsdon Orkin & Hanson, P.C.

(57) ABSTRACT

A controlling member (a controlling pin 10) is inserted through an insertion hole 7 of a mold 1 and projected into a cavity 6. After a pipe P as an insert member is arranged at a predetermined position in the cavity 6, the pipe P is held in the cavity 6 by inserting a tip of the controlling pin 10 into a hole h of the pipe P at the end $p_1$, or by inserting the end $p_1$ of the pipe P into a cave 21 of the controlling member. A molten aluminum alloy is then poured through a gate 5 into the cavity 6 under such the condition, to enclose the pipe P with the aluminum alloy. Dislocation of the pipe P caused by kinetic and thermal energies of the poured aluminum alloy is suppressed by the controlling pin 10 or block 20 at the end $p_1$. Since the enclosed pipe P has its end $p_1$ opened at a predetermined position, a cast product obtained in this way can be used as a brake caliper or the like having an inner hydraulic circuit.

18 Claims, 5 Drawing Sheets

EFFECT OF A CONTROLLING PIN ON POSITIONING AN END OF A PIPE

DISLOCATION OF AN END OF A PIPE
WITHOUT USE OF A CONTROLLING PIN

INTERNAL CHILL CASTING METHOD FOR MANUFACTURING A CAST PRODUCT CONTAINING A PIPE THEREIN

BACKGROUND OF THE INVENTION

The present invention relates to an internal chill casting method for manufacturing a cast product containing a pipe, which serves as a hydraulic circuit, therein while holding the pipe at a predetermined position of a cavity during pouring a molten aluminum alloy.

A product containing an inner hydraulic circuit has been manufactured so far by drilling a cast body. However, formation of a complicated hydraulic circuit is impossible by drilling, and an opening formed by drilling must be plugged. On the other hand, formation of such a hydraulic circuit is easy according to an internal chill casting method, whereby a pipe (hereinafter referred to as "an insert member") is located at a predetermined position in a cavity of a mold and a molten metal (hereinafter referred to as "an enclosing material") is then poured to the cavity. The internal chill casting method also facilitates post-processing of a cast product.

A pipe to be enclosed in a cast product is coated with heat insulating material or plated with a proper metal layer, in order to inhibit melt-down and to improve its adhesiveness to the enclosing material. In some cases, the pipe is cooled by supply of a cooling medium therein during pouring a molten metal.

When a molten metal is poured into a cavity of a mold having a pipe arranged therein, the pipe (the insert member) is likely dislocated due to a pressure of the molten metal. If the pipe is fixed at a dislocated position in a cast body, a hydraulic circuit can not be formed with a predetermined pattern. Deviation of the hydraulic circuit from the predetermined pattern causes troubles in the following steps. For instance, when the pipe-enclosing cast product is used as a brake caliper having an inner hydraulic circuit, attachments such as a bleed screw can not be coupled with the hydraulic circuit with high reliability.

The inventors proposed a method of inhibiting dislocation of a pipe during casting, as disclosed in JP 2000-254768A. According to the proposed method, the pipe is fixed in a cavity of a mold by clamping both ends of the pipe between upper and lower mold members or fixed with a core. Such a pipe held in a mold is heated up to a high temperature with a heat from a molten aluminum alloy poured into the cavity, so as to be thermally expanded or deformed. If both ends of the pipe are clamped between the metal mold members under such conditions, a middle part of the pipe apart from the clamped ends is likely to change its position. In some cases, a gap between the pipe and an inner surface of the mold becomes narrower. The pipe may project to the outside from a cast product. If the pipe in the cast product is greatly deviated from a predetermined position, it is necessary to form a big hole for coupling a bleed screw or the like to the pipe.

SUMMARY OF THE INVENTION

The present invention aims at provision of a cast product containing an hydraulic circuit therein without problems as above-mentioned. Formation of such a hydraulic circuit with high accuracy corresponding to a predetermined pattern is realized by fixing a controlling member, which controls a deforming direction of a pipe caused by thermal expansion, to a mold so as to hold the pipe at a predetermined position in a cast body.

According to the present invention, a controlling member is fixed to a mold in such the manner that it extends toward a cavity of the mold. A pipe (an insert member) is held in the cavity by insertion of the controlling member into at least one opening of the pipe or by inserting at least one end of the pipe into a hole of the controlling member. Thereafter, a molten aluminum alloy is poured into the cavity so as to enclose the pipe in a cast body.

The controlling member is preferably one, which adjustably extends through a wall of the mold into the cavity. Such an adjustable controlling member facilitates positioning of the pipe and ejection of a cast product. When a pin is used as the controlling member, the pipe is held at a predetermined position by inserting a tip of the pin into an opening of the pipe. The pin may be stepped at a middle part toward its tip, or an inner surface of the pipe may be chamfered at the opening, in order to inhibit inflow of a molten alloy into the pipe.

The stepped pin can have a shaft of a diameter larger than an inner diameter of the pipe, so its heat capacity is big enough to rapidly solidify a molten alloy in contact with the stepped part. Consequently, the pipe is protected from inflow of the molten alloy. Such the step is favorably formed with a right angle at a middle part of the pin, so as to enable insertion of the pin in face-to-face contact with a surface of the pipe.

The chamfered inner surface of the pipe at the opening arises a surface tension effective for suppressing inflow of a molten alloy into the pipe. Inflow of a molten alloy is also inhibited by coating the pin with a single or complex layer of such elements or compounds as Ti, TiN, TiC, CrN and BN, which are poor of wettability to a molten aluminum alloy, or by chemical conversion of a surface of the pin to a nitrided state or the like.

A controlling block having a hole for insertion of an end part of the pipe therein may be used, instead of the pin having a tip inserted into the opening of the pipe. The pipe may be also held at a predetermined position in the cavity, by attaching a bracket to the pipe, fixing the bracket at a predetermined position of a mold facing to the cavity, and inserting a controlling pin through a wall of the mold into a hole of the bracket.

An end of a pipe, with which the controlling member is coupled, may be located at a position apart from an inner surface of the mold toward the cavity. A cast product obtained in this case contains the pipe having the end declined from its surface, so that a properly predetermined profile of the controlling member can be transferred to an inner part of the cast product. Consequently, a working hole for attachment of a bleed screw can be designed to a size smaller than a diameter of the pipe, in a process of manufacturing a brake caliper.

The declined end of the pipe also advantageously assures the state that a boundary between the pipe and the enclosing material is not exposed on a surface of the cast product, and improves quality of the cast product. For instance, the cast product is machined to a proper shape with ease, since the pipe and the enclosing material different in hardness from each other are not simultaneously machined.

A gas pressure may be applied to the pipe during pouring a molten aluminum alloy into the cavity of a mold. The gas pressure effectively inhibits inflow of the molten alloy into the pipe and also maintains an initial shape of the pipe. Cool gas such as inert gas may be supplied into the pipe for application of such a gas pressure. Melting of the pipe can be also inhibited by the cool gas.

One open end of the pipe fixed to the mold may be shut with a plug, so as to expand a gas in the pipe with a heat during pouring a molten aluminum alloy. Such thermal expansion of the gas keeps the interior of the pipe at a positive pressure effective for inhibiting inflow of the molten alloy.

DETAILED DESCRIPTION OF THE INVENTION

The other features of the present invention will become apparent from the following explanation of an internal chill casting method designed for production of a brake caliper containing a hydraulic circuit therein.

Figure 1:
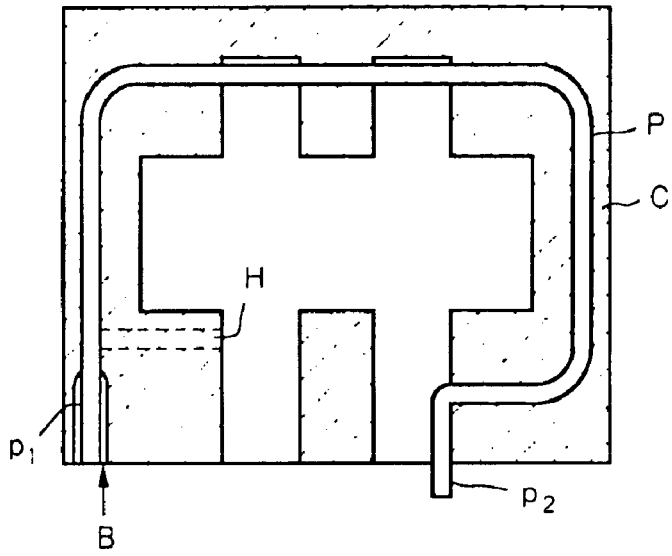
FIG. 1 is a schematic sectional view illustrating a brake caliper manufactured by an internal chill casting method according to the present invention.

A cast product for use as a brake caliper has a cast body C enclosing a pipe P therein, as shown in FIG. 1. The pipe P has one end $p_1$ opened on a surface of the cast body C and the other end $p_2$ projected from the cast body C. The cast body C is drilled to a position facing to the pipe P so as to form a hole H for a hydraulic circuit, and a hole B for attachment of a bleed screw is further formed.

Figure 2:
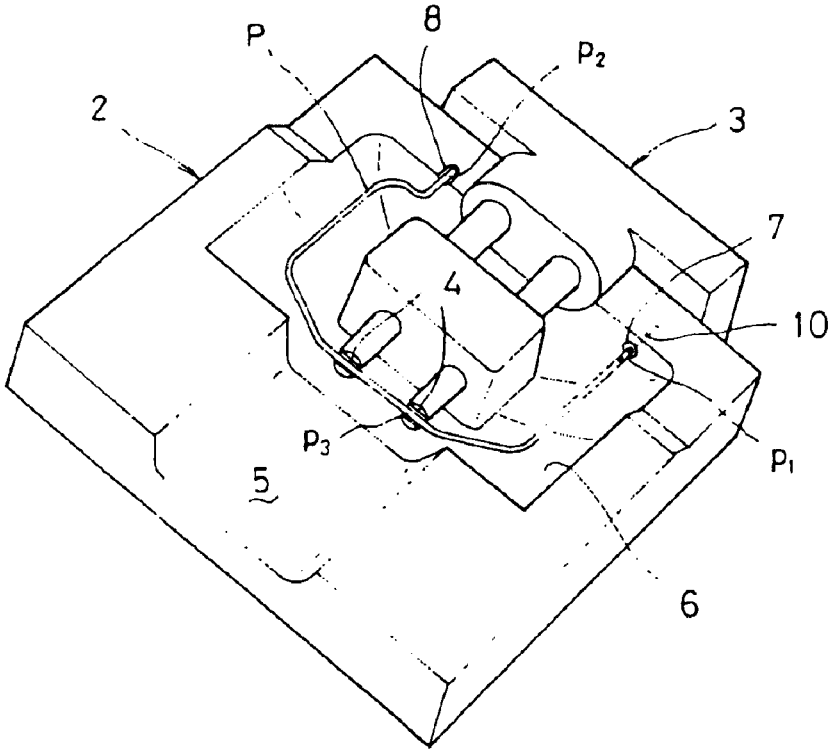
FIG. 2 is a bird's eye view illustrating a lower mold member wherein a pipe is arranged.

The pipe P as the insert member located in a lower mold member 2 has one end $p_1$provided with a controlling member (a controlling pin 10) according to the present invention, the other end $p_2$ clamped between a lower mold member 2 and an upper mold member (not shown) and a middle part $p_3$ held in a groove(s) 4 of a core 3, as shown in FIG. 2.

After the upper mold member is put on the lower mold member 2 to close the mold 1, a molten aluminum alloy is poured through a gate 5 to a cavity 6 so as to produce a cast body C enclosing the pipe P therein.

The pipe P is likely to dislocate in the cavity 6 due to kinetic and thermal energies of the molten aluminum alloy poured into the cavity 6. Dislocation of the pipe P is suppressed by the controlling member, which is adjustable provided in the mold 1. The controlling member may be a controlling pin 10 whose tip is inserted into an end opening or another opening of the pipe P or a controlling block having a cave or hole into which a part of the pipe P is inserted.

The controlling member is preferably made of tool steel or titanium, which endures a high-temperature atmosphere derived from pouring a molten aluminum alloy into the cavity. Dislocation of the pipe P is also suppressed by inserting the controlling pin 10 into a bracket attached to the pipe P. The bracket is preferably made of an Al-Si alloy having a low melting temperature, since it is dissolved in the molten aluminum alloy and consumed as a part of the cast body C.

A position for inhibiting dislocation of the pipe P is determined at at least a side of the hole B for attachment of a bleed screw, since the hole B shall be formed with high dimensional accuracy. The other end $p_2$ of the pipe P at the opposite side may be prevented from dislocation by inserting it into a hole of the mold 1, instead of using the same controlling member. For instance, the other end $p_2$ is put in a positioning groove 8 formed on a matching plane of the lower mold member 2 and clamped between the lower mold member 2 and the upper mold member.

Figure 3:
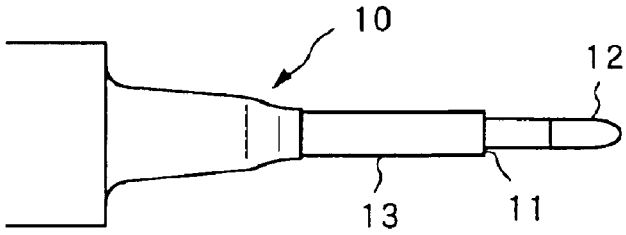
FIG. 3 is a partial view illustrating a controlling pin to be inserted into one end of a pipe.
Figure 4A:
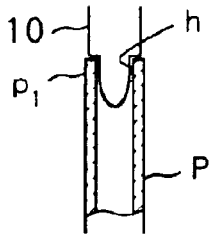
FIG. 4A is a partial sectional view for explaining an example wherein a tip of a controlling pin is inserted into an open end of a pipe.
Figure 4B:
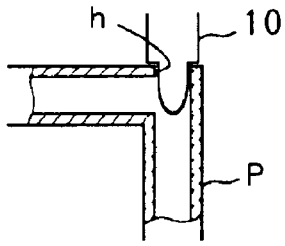
FIG. 4B is a partial sectional view for explaining an example wherein a tip of a controlling pin is inserted into an opening of a pipe at a middle part.

The controlling pin having a tip inserted into an opening of the pipe P may be a controlling pin 10 which is stepped 11 at its middle part and/or tapered 12 at its tip, as shown in FIG. 3. Such the controlling pin 10 is adjustably provided in the mold 1 in the manner such that it extends through an insertion hole 7 of the mold 1 to the cavity 6. An opening h of the pipe P for insertion of the controlling pin 10 may be either an end opening $p_1$ (shown in FIG. 4*a*) or an opening (shown in FIG. 4*b*) formed at a middle part of the pipe P.

Figure 4C:
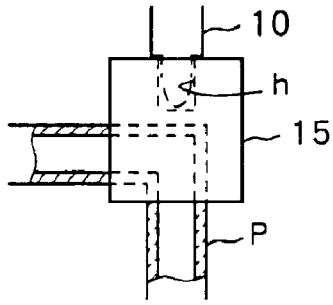
FIG. 4C is a partial sectional view for explaining an example wherein a tip of a controlling pin is inserted into a cave of a bracket attached to a pipe.

The pipe P may be squeezed to a small diameter at its end by drawing or the like, so as to enable formation of a hole for a bleed screw in a small size. A hole h for insertion of the controlling pin 10 may be formed in a bracket 15 attached to the pipe P, as shown in FIG. 4C. A position for coupling the bracket 15 to the pipe P can be freely changed, and a plurality of pipes P may be attached to the bracket 15.

A tapered tip 12 of the controlling pin 10 is inserted into the hole h of the pipe P, until the step 11 comes in contact with a side surface of the pipe P to plug the hole h with the controlling pin 10. The step 11 is preferably formed with a right angle with respect to a shaft of the controlling pin 10, in order to hold the step 11 in close contact with the side or circumferential surface of the pipe P without any gap which causes inflow of a molten alloy. Of course, the wording of "right angle" means not only geometric 90 degree, but also 90 degree $\pm\alpha$ to the extent that the step 11 comes in face-to-face contact with a wall of the pipe P.

Figure 5:
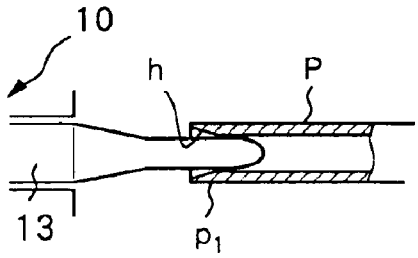
FIG. 5 is a partial sectional view for explaining an example wherein a tip of a controlling pin is inserted into an open end surrounded with an inner chamfered surface of a pipe.

An inner surface of the pipe P at the end pi for insertion of the controlling pin 10 may be chamfered (as shown in FIG. 5) so as to hold the controlling pin 10 in contact with the chamfered surface, instead of the right angular step 11. The chamfered surface brings out a surface tension effective for inhibiting inflow of a molten alloy and also facilitates insertion of the controlling pin 10 to the pipe P.

Inflow of a molten alloy can be also inhibited by subjecting the controlling pin 10 to such surface treatment as coating with a layer of Ti, TiC, TiN and/or BN or nitriding. Such surface treatment also effectively inhibits sticking of the controlling pin 10 or the controlling block 20 to an aluminum alloy, so that the controlling pin 10 or the controlling block 20 can be easily pulled out after completion of casting.

Figure 6A:
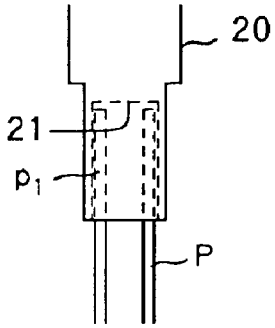
FIG. 6A is a partial view for explaining another example wherein an end of a pipe is inserted into a cave of a controlling block.
Figure 6B:
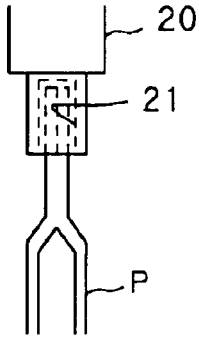
FIG. 6B is a partial view for explaining another example wherein a squeezed end of a pipe is inserted into a cave of a controlling block.

A pipe P can be held at a predetermined position by inserting its end part to a controlling block 20. Such the controlling block 20 may be one having a cave 21 into which an end $p_1$ of the pipe P is inserted (shown in FIG. 6*a*) or another having a cave 21 into which a squeezed end of the pipe P is inserted (shown in FIG. 6*b*). In any case, the same bracket 15 as shown in FIG. 4*c* may be coupled with the pipe P and inserted into the cave 21 of the controlling block 20, to secure the pipe P at a predetermined position. Inflow of a molten metal can be inhibited by surface-treatment of the controlling block 20 in the same way.

Figure 7A:
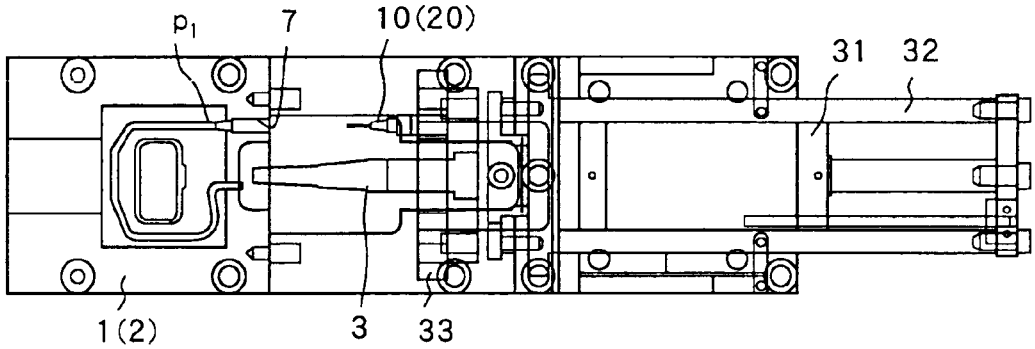
FIG. 7A is a view illustrating an initial state of a core cylinder in prior to pouring of a molten aluminum alloy into a cavity of a mold.

The controlling pin 10 or the controlling block 20 is adjustably set in the mold 1 in the manner such that is extends through a wall of a mold 1 to the cavity 6 of the mold 1. For instance, a base 33 is fixed to a frame 32 of a core cylinder 31 for carrying a core 3 front and back, and the controlling pin 10 or the controlling block 20 is fixed to the base 33, as shown in FIG. 7*a*. Since the controlling pin 10 or the controlling block 20 moves front and back in response to drive of the core cylinder 31, an insertion hole 7 is formed in a lower mold member 2 at a position to which the controlling pin 10 or the controlling block 20 is directed.

Figure 7B:
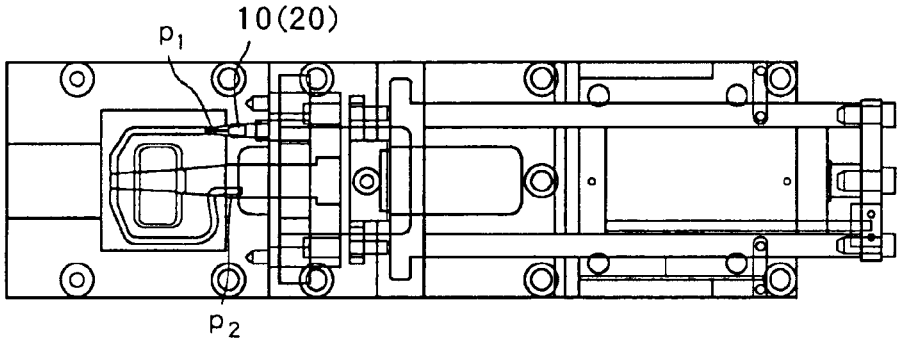
FIG. 7B is a view illustrating arrangement of a pipe in a cavity of a mold at a position for insertion of a controlling pin.

When the core 3 is carried frontward and set in the lower mold member 2 by drive of the core cylinder 31, the controlling pin 10 or the controlling block 20 is inserted into the insertion hole 7. Thereafter, a pipe P is located in a cavity of the mold 1 in the manner such that a tip of the controlling pin 10 is inserted into a hole h of the pipe P or that one end $p_1$ of the pipe P is inserted into the controlling block 20, as shown in FIG. 7*b*. A middle part of the pipe P is put in an insertion groove 4 (FIG. 2) of the core 3. The other end $p_2$ of the pipe P is fixed by locating the other end $p_2$ in a positioning groove 8 of the lower mold member 2 (FIG. 2) or by inserting the other end $p_2$ in a hole of the core 3.

After the pipe P is coupled with the controlling pin 10 or the controlling block 20 in the cavity 6, the mold 1 are clamped. A molten aluminum alloy is poured through a gate 5 into the cavity 6 under such the condition, to enclose the pipe P with the aluminum alloy. At this time, a force is applied to the pipe P due to kinetic and thermal energies of the poured molten aluminum alloy. However, one end $p_1$ of the pipe P is allowed for axial motion but prevented from dislocation along a radial direction due to coupling with the controlling pin 10 or the controlling block 20. The pipe P is restrained at the other end $p_2$ between the lower mold member 2 and the upper mold member or the core 3, and at the middle part by the insertion groove 4 of the core 3. Consequently, the applied force is absorbed as axial dislocation of the pipe P without radial dislocation at the end $p_2$, where formation of a hole H for a hydraulic circuit is estimated. Of course, the pipe P tends to elongate along a rightward direction in FIG. 2 due to its thermal expansion caused by a heat of the poured molten aluminum alloy. However, such elongation of the pipe P is suppressed by the controlling pin 10 or the controlling block 20, so that the end pi of the pipe P enclosed in the cast product is opened on a surface of a cast product at a predetermined position.

Thermal expansion of the pipe P is also effective for pressing the end $p_1$ onto the controlling pin 10 or the controlling block 20 without formation of any gap which allows inflow of a molten alloy into the pipe P. When the other end $p_2$ of the pipe P is optionally shut with the mold 1 or a plug, an interior of the pipe P is maintained at a positive pressure due to volumetric expansion of gas in the pipe P heated by the molten aluminum alloy. The positive pressure surely inhibits inflow of a molten alloy into the pipe P.

Figure 7C:
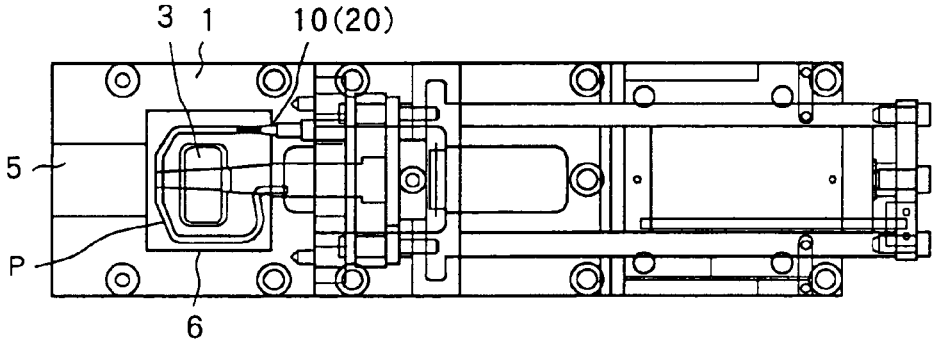
FIG. 7C is a view illustrating the state that a controlling pin is inserted into an open end of a pipe.

FIG. 7 shows the state that one end $p_1$ of the pipe P is plugged with the controlling pin 10 or the controlling block 20. However, when a controlling pin 10 or a controlling block 20 is attached to an opening h of the pipe P formed at its middle part, both ends $p_1$ and $p_2$ of the pipe P is opened as such. In such a case, plugs may be attached to both of the opened ends $p_1$ and $p_2$ of the pipe P, so as to maintain an interior of the pipe P at a positive pressure during pouring a molten aluminum alloy. Such a positive pressure is also kept by applying a gas pressure to the pipe P from the outside gas source.

If the controlling pin 10 or the controlling block 20 is pulled out from the pipe P at a time when solidification of the poured molten aluminum alloy approaches the end, the pipe P may be unfavorably dislocated due to pulling motion of the controlling pin 10 or the controlling block 20. In order to avoid such dislocation of the pipe P, the controlling pin 10 or the controlling block 20 is preferably pulled out from the pipe P at a time when solidification of the aluminum alloy progresses to some extent.

Figure 8:
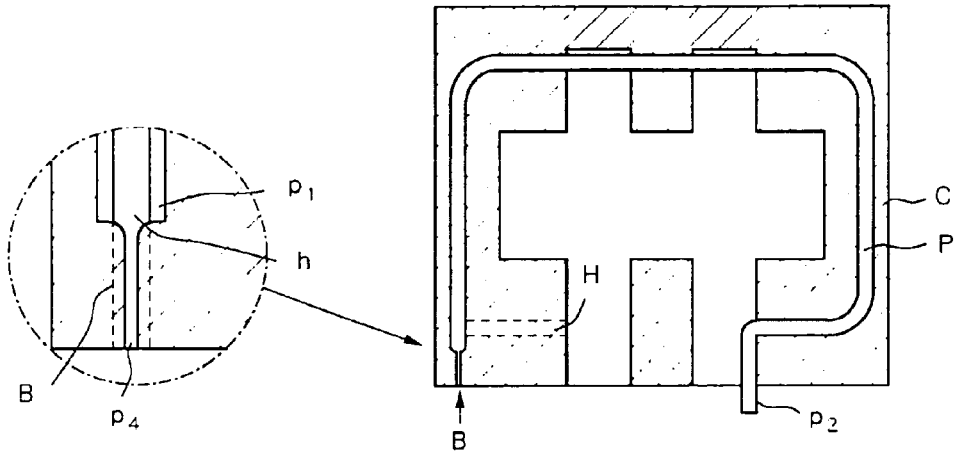
FIG. 8 is a schematic sectional view illustrating a cast product containing a pipe having an open end declined from a surface of the cast product.

Although the open end $p_1$ of a pipe P (in FIG. 7) at a side of a hole H for hydraulic circuit may be held in contact with an inner surface of a mold 1, the open end may be located at a position apart from the inner surface of the mold 1 toward a cavity 6. When the end $p_1$ of the pipe P is located in this way using a controlling member whose outer diameter is smaller than an outer diameter of the pipe P, an obtained cast product encloses the pipe P having the end $p_1$ declined from a surface toward an inner part, and a small continuous hole $p_4$ opens on the surface of a cast body C, as shown in FIG. 8. Consequently, a cast product of high quality is obtained due to absence of a boundary between a cast body C and the pipe P on a surface of the cast body C.

Location of the end pi of the pipe P at the inner part is advantageous for formation of a working hole B for a bleed screw without necessity of squeezing the end $p_1$ of the pipe P regardless its diameter. Such the location also enables formation of a working hole B for a bleed screw by the controlling pin 10 without machining the pipe P which is generally soft and poor of machinability. The controlling pin 10 made of tool steel or the like can be shaped to a small size due to its good melting resistance, so as to make the working hole B for a bleed screw smaller in size. If one end $p_1$ of the pipe P at a side of a bleed screw exposes on a surface of the cast body C, the pipe P can not be generally made smaller in size accounting melting during pouring a molten aluminum alloy. In such a case, a pipe P shall be preparatively squeezed at its end before arrangement in the mold 1, in order to make a hole H for a hydraulic circuit smaller in size.

EXAMPLE

A pipe P as an insert member was prepared by chamfering an inner surface of an aluminum alloy (JIS A3003) pipe of 6 mm in outer diameter and 1.5 mm in thickness at its open end $p_1$ (shown in FIG. 5) and forming the pipe to a proper shape. The pipe P was set in a lower mold member 2 (as shown in FIG. 2). A controlling pin 10, which extended through an insertion hole 7 of the lower mold member 2 to a cavity 6, was inserted into a hole h of the pipe P at a side of the end $p_1$. The other end $p_2$ of the pipe P was fixedly clamped between the lower mold member 2 and an upper mold member. A middle part $p_3$ of the pipe P was put in an insertion groove 4 of a core 3.

After arrangement of the pipe P, an upper mold member was put on the lower mold member 2, and these mold members were clamped together to build up a mold 1. A molten aluminum alloy (JIS A4CAC) held at 700° C. was poured into the cavity 6. 20 pieces of brake calipers enclosing the pipes P therein were manufactured in this way.

Figure 9:
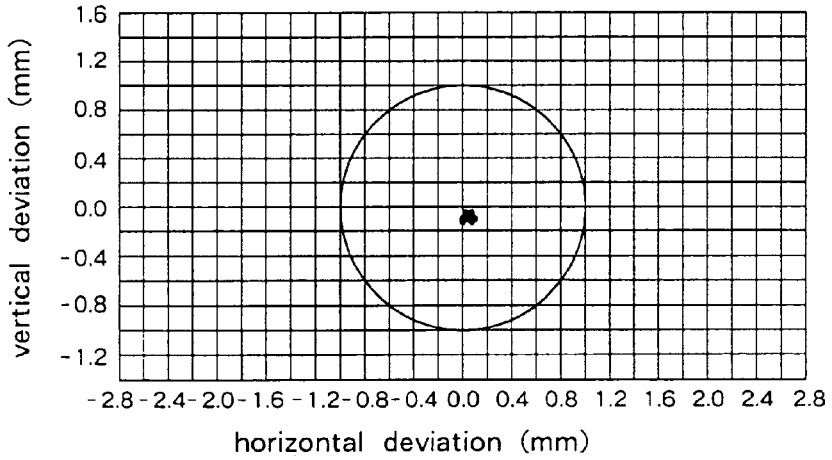
FIG. 9 is a graph illustrating an effect of a controlling pin on position of a center of a pipe in a cast product without deviation

A center of the pipe P in each cast product was measured at its end $p_1$ into which the controlling pin 10 had been inserted. Measuring results are shown in FIG. 9. It is noted that a hole h at the end $p_1$ was accurately opened at a predetermined position without substantial deviation along either horizontal or vertical direction.

Figure 10:
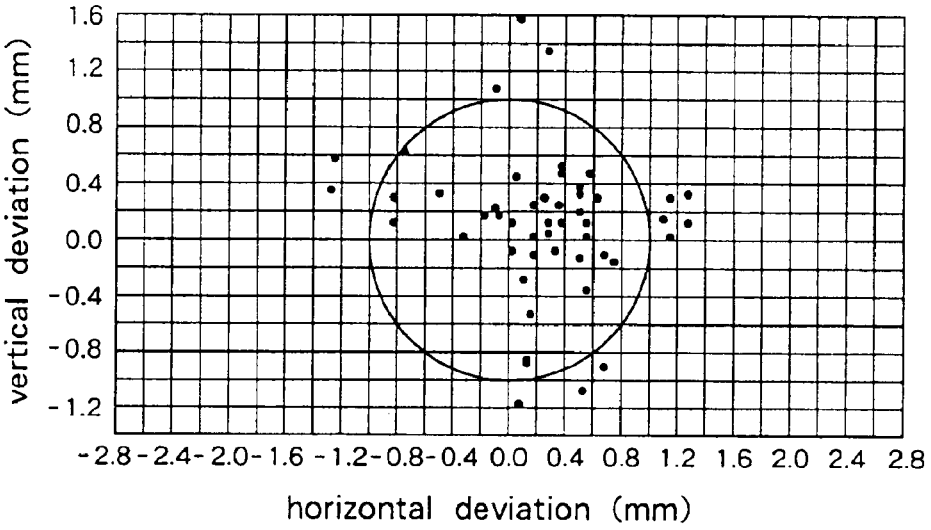
FIG. 10 is a graph illustrating deviation of a center of a pipe in a cast body without use of a controlling pin

For comparison, the same pipe P was clamped between the mold 1 and enclosed in a cast body C without use of a controlling pin 10. When the position of a center of the pipe P in the cast body C was measured, it was often deviated from a predetermined position by 1.5 mm or longer along both of horizontal and vertical directions, as shown in FIG. 10. Due to such deviation of the pipe P, formation of a working hole H for a bleed screw was inevitably formed in a big size to cancel the deviation from the predetermined position.

According to the present invention as above-mentioned, a controlling pin is inserted into at least one end of a pipe, or at least one end of the pipe is inserted into a controlling block during pouring a molten aluminum alloy into a cavity of a mold, so as to inhibit radial dislocation of the end of the pipe. Due to restraint of the end of the pipe, the enclosed pipe is opened on a surface of the cast product at a predetermined position. Such accurate location of the pipe facilitates works in the following step, e.g. formation of a hole for attachment of a bleed screw when the cast product is processed to a brake caliper.

What is claimed is:

1. A method for manufacturing an aluminum cast product enclosing a pipe inserted therein, which comprises the steps of:

projecting a controlling member into a cavity of a mold;

arranging a pipe at a predetermined position in said cavity of said mold;

holding a portion of said pipe in the cavity by receiving the portion of said pipe in a groove of a core member, a portion of the core received within the cavity;

inserting said controlling member into at least one opening of said pipe or insertion of at least one end of said pipe into a hole of said controlling member; and pouring a molten aluminum alloy into said cavity so as to enclose said pipe with said aluminum alloy, wherein said pipe is free to move in an axial direction relative to said mold until said aluminum alloy hardens.

2. The method defined in claim 1, wherein said controlling member is adjustably provided toward a center of the cavity.

3. The method defined in claim 1, wherein the controlling member has a tip inserted into the opening of the pipe.

4. The method defined in claim 3, wherein the controlling member is stepped at a middle part toward the tip.

5. The method defined in claim 3, wherein the pipe has the opening whose inner surface is chamfered.

6. The method defined in claim 1, wherein the controlling member has a hole to which an end of the pipe is inserted.

7. The method defined in claim 1, wherein the controlling member has a surface layer which endures a high-temperature atmosphere caused by pouring the molten aluminum alloy, wherein the surface layer is comprised of elements or compounds selected from the group consisting of Ti, TiN, TiC, CrN and BN.

8. A method for production of aluminum cast product enclosing a pipe therein, which comprises the steps of:

coupling a bracket having a hole to a pipe;

arranging said pipe at a predetermined position in a cavity of a mold;

holding a portion of said pipe in said the cavity by receiving the portion of said pipe in a groove of a core member, a portion of the core received within the cavity:

inserting a controlling pin, which extends through a wall of the mold to the said cavity, into said hole of said bracket; and pouring a molten aluminum alloy into said cavity so as to enclose said pipe with said aluminum alloy, wherein said pipe is free to move in an axial direction relative to said mold until said aluminum alloy hardens.

9. The method defined in claim 1, wherein compressed gas is supplied to the pipe during pouring of the molten aluminum alloy.

10. The method defined in claim 1, wherein a plug is attached to an open end of the pipe.

11. The method defined in claim 8, wherein compressed gas is supplied to the pipe during pouring of the molten aluminum alloy.

12. The method defined in claim 9, wherein the compressed gas is a cool gas.

13. The method defined in claim 12, wherein the cool gas is an inert gas.

14. The method defined in claim 11, wherein the compressed gas is a cool gas.

15. The method defined in claim 14, wherein the cool gas is an inert gas.

16. The method defined in claim 8, wherein a plug is attached to an open end of the pipe.

17. A method for manufacturing an aluminum cast product enclosing a pipe inserted therein, which comprises the steps of:

projecting a controlling member into a cavity of a mold;

arranging a pipe at a predetermined position in said cavity of said mold;

holding a portion of said pipe in said the cavity by receiving the portion of said pipe in a groove of a core member, a portion of the core received within the activity:

inserting said controlling member into at least one opening of said pipe or insertion of at least one end of said pipe into a hole of said controlling member;

pouring a molten aluminum alloy into said cavity so as to enclose said pipe with said aluminum alloy, wherein said pipe is free to move in an axial direction relative to said mold until said aluminum alloy hardens; and wherein said controlling member is configured to allow axial movement of said pipe without radial dislocation.

18. A method for production of aluminum cast product enclosing a pipe therein, which comprises the steps of:

coupling a bracket having a hole to a pipe;

arranging said pipe at a predetermined position in a cavity of a mold;

holding a portion of said pipe in the cavity by receiving the portion of said pipe in a groove of a core member, a portion of the core received within the cavity;

inserting a controlling pin, which extends through a wall of the mold to the said cavity, into said hole of said bracket; and pouring a molten aluminum alloy into said cavity so as to enclose said pipe with said aluminum alloy, wherein said pipe is free to move in an axial direction relative to said mold until said aluminum alloy hardens; and wherein said controlling member is configured to allow axial movement of said pipe without radial dislocation.

* * * * *

UNITED STATES PATENT AND TRADEMARK OFFICE

CERTIFICATE OF CORRECTION

PATENT NO. : 6,739,378 B2
DATED : May 25, 2004
INVENTOR(S) : Sugita et al.

It is certified that error appears in the above-identified patent and that said Letters Patent is hereby corrected as shown below:

Column 2,
Line 9, “such the manner” should read -- such a manner --
Line 16, “one, which” should read -- one which --
Line 32, “Such the step” should read -- Such step --
Line 37, “arises a surface” should read -- creates a surface --

Column 3,
Line 16, “during pouring a” should read -- during pouring of a --
Line 53, “cylinder in prior” should read -- cylinder prior --
Line 66, “deviation” should read -- deviation. --

Column 4,
Line 2, “pin” should read -- pin. --
Line 15, “facing to the” should read -- facing the --
Line 65, “Such the controlling” should read -- Such controlling --

Column 5,
Lines 42-43, “Such the controlling” should read -- Such controlling --
Line 67, “by drive of” should read -- by the drive of --

Column 6,
Line 3, “in the manner such” should read -- in such a manner --
Lines 13-14, “the mold are clamped” should read -- the mold is clamped --
Line 15, “such the condition, to” should read -- such condition to --
Line 52, “pipe P is opened” should read -- pipe P are opened --

Column 7,
Line 21, “regardless its” should read -- regardless of its --
Line 21, “Such the location” should read -- Such location --
Line 29, “exposes” should read -- is exposed --
Line 31, “accounting” should read -- due to --
Line 55, “20 pieces” should read -- Twenty pieces --

Column 8,
Line 61, “in said the cavity” should read -- in the cavity --
Line 64, “cavity:” should read -- cavity; --

UNITED STATES PATENT AND TRADEMARK OFFICE

CERTIFICATE OF CORRECTION

PATENT NO. : 6,739,378 B2
DATED : May 25, 2004
INVENTOR(S) : Sugita et al.

It is certified that error appears in the above-identified patent and that said Letters Patent is hereby corrected as shown below:

Column 9,
Line 30, “in said the cavity” should read -- in the cavity --
Lines 31-32, “within the activity:” should read -- within the cavity; --

Column 10,
Line 23, “bracket; and” should read -- bracket; --

Signed and Sealed this

Seventh Day of December, 2004

JON W. DUDAS
*Director of the United States Patent and Trademark Office*